US005867955A

United States Patent [19]

Russell

[11] Patent Number: 5,867,955

[45] Date of Patent: Feb. 9, 1999

[54] PANEL-TO-PANEL CONNECTORS FOR OFFICE PARTITIONS

[75] Inventor: Scott H. Russell, Kalamazoo, Mich.

[73] Assignee: Steelcase Inc., Grand Rapids, Mich.

[21] Appl. No.: 892,010

[22] Filed: Jul. 14, 1997

[51] Int. Cl.[6] ..... E04B 2/74

[52] U.S. Cl. ..... 52/239; 52/285.2; 52/582.1

[58] Field of Search ..... 52/239, 582.1, 52/284, 285.1, 285.2, 285.3

[56] References Cited

U.S. PATENT DOCUMENTS

| | | | |
|---|---|---|---|
| 3,842,555 | 10/1974 | Korell | 52/285.2 |
| 3,868,800 | 3/1975 | Peterson | 52/285.2 |
| 4,545,168 | 10/1985 | Dalton, Jr. . | |
| 4,625,483 | 12/1986 | Zacky et al. . | |
| 4,631,881 | 12/1986 | Charman . | |
| 4,635,417 | 1/1987 | Larouche . | |
| 4,716,699 | 1/1988 | Crossman et al. | 52/239 |
| 4,833,848 | 5/1989 | Guerin . | |
| 4,914,878 | 4/1990 | Tamaki et al. . | |
| 4,962,805 | 10/1990 | Allen . | |
| 4,996,811 | 3/1991 | Dull et al. . | |
| 5,003,740 | 4/1991 | Dull et al. . | |
| 5,005,325 | 4/1991 | Dull et al. . | |
| 5,033,526 | 7/1991 | DeLong et al. . | |
| 5,056,577 | 10/1991 | DeLong et al. . | |
| 5,134,826 | 8/1992 | La Rouche et al. . | |
| 5,214,889 | 6/1993 | Nienhuis et al. . | |
| 5,219,406 | 6/1993 | Raz . | |
| 5,347,778 | 9/1994 | Bray | 52/239 |
| 5,377,466 | 1/1995 | Insalaco et al. . | |
| 5,406,760 | 4/1995 | Edwards . | |
| 5,487,246 | 1/1996 | Hodges et al. . | |
| 5,511,348 | 4/1996 | Cornell et al. | 52/239 |
| 5,586,593 | 12/1996 | Schwartz | 52/239 |
| 5,638,650 | 6/1997 | Edwards | 52/239 |
| 5,642,593 | 7/1997 | Shieh . | |

OTHER PUBLICATIONS

Exhibit A discloses a prior art publication entitled *Elective Elements Panel Assembly Installation—Installation Directions*, published by Steelcase more than one year prior to filing the present application.

*Primary Examiner*—Michael Safavi

*Attorney, Agent, or Firm*—Price, Heneveld, Cooper, DeWitt & Litton

[57] ABSTRACT

A partition system is provided for subdividing a building space. The partition system includes different partition panels interconnectable in one of in-line, "X", "T", or "L" shaped arrangements by a connection system that simulates a "post" type connection, but which does not include vertically extending upright components. The connection system includes vertically spaced joint brackets for connecting the panels in the selected arrangement. The joint brackets each have sides with threaded connectors and barbed notches on each side. Vertically spaced frame brackets are used to rigidly connect the frame sections to the joint brackets. Trim pieces are constructed to securely engage the barbed notches on unoccupied sides of the joint brackets when there is a gap formed by absence of a panel on the unoccupied sides.

18 Claims, 6 Drawing Sheets

PANEL-TO-PANEL CONNECTORS FOR OFFICE PARTITIONS

BACKGROUND OF THE INVENTION

The present invention concerns a partition system including a connection system for interconnecting the ends of adjacent partitions with multi-functional brackets that simulate post-type connectors, but that do not interfere with routing of wiring horizontally or vertically through the connection area.

Some partitions have panels with vertical side edges configured to be directly connected together, without using any intermediate post-type connector that spaces the vertical side edges apart. However, when the vertical side edges of partitions are directly connected together, there is no space at the connection for vertical routing of wiring, nor is there space at the connection for connecting a perpendicular partition thereto, unless the panel itself provides it. For this reason, partitions are often interconnected by post-type connectors to form offices. Usually, the post-type connectors having elongated vertical members that extend the height of the partitions. However, such post connectors tend to be undesirably expensive to manufacture, ship, and install. Further, most post-type connectors for panels have vertical structural components that to some extent interfere with horizontal cable routing. Thus, a less expensive, mechanically simpler, and more flexible connection system is desired.

One known partition system shown in U.S. Pat. No. 5,406,760 utilizes a connection system consisting of an X-shaped center connector, arrowhead-shaped frame-engaging connectors, disk plates, and toggle clamps (see FIGS. 11–13 of U.S. Pat. No. 5,406,760). Noticeably, the arrowhead shaped connectors and the toggle clamps have relatively complex three-dimensional shapes. Further, the clamp-type joint disclosed involves several components, and is relatively complex and expensive. Still further, if the clamp is improperly installed or not fully set, there is a risk of accidental and unexpected release. It is also noted that nothing in the arrangement of the '760 patent provides for supporting trim on its connection system to cover the joint formed.

Thus, a system solving the aforementioned problems and having advantages over known art is desired.

SUMMARY OF THE INVENTION

In one aspect, the present invention includes a partition system for subdividing a building space. The partition system includes a plurality of panels and a connection system for interconnecting the panels together around a post-simulating joint in one of in-line, "T", or "L" shaped arrangements. The connection system includes vertically spaced joint brackets for selectively connecting the panels in the one selected arrangement, each joint bracket having sides with threaded connectors and barbed notches. Vertically spaced frame brackets are connected to vertically spaced frame sections on the panels at their vertical side edges and to selected ones of the threaded connectors. Trim pieces are attached to the barbed notches on unoccupied sides of the joint brackets where there is no panel attached, the trim pieces each being shaped to aesthetically cover an open area between the panels on the unoccupied sides.

In another aspect, the present invention includes a partition system defining a pair of frames with vertical side edges. The frames each include horizontal frame members, and also include uprights spaced horizontally from the vertical side edges for supporting the horizontal frame members. The horizontal frame members have cantilevered end sections extending to the vertical side edges from the uprights. Frame brackets are provided, each having a tail end configured for rigid secure connection to a respective one of the cantilevered end sections, and having an opposite end. The frame brackets each are relatively flat parts, with the tail end and the opposite end lying substantially in a common plane, such that the parts are easily made. Joint brackets are also provided having sides and apertures on each side for receiving fasteners to secure the opposite ends of the frame brackets to the joint brackets on selected sides.

These and other features, advantages and objects of the present invention will be further understood and appreciated by those skilled in the art by reference to the following specification, claims and appended drawings.

BRIEF DESCRIPTION OF THE DRAWINGS

FIG. 1A is a fragmentary enlarged perspective view of the circled area labeled IA in FIG. 1;

DETAILED DESCRIPTION OF PREFERRED EMBODIMENT

Figure 1:
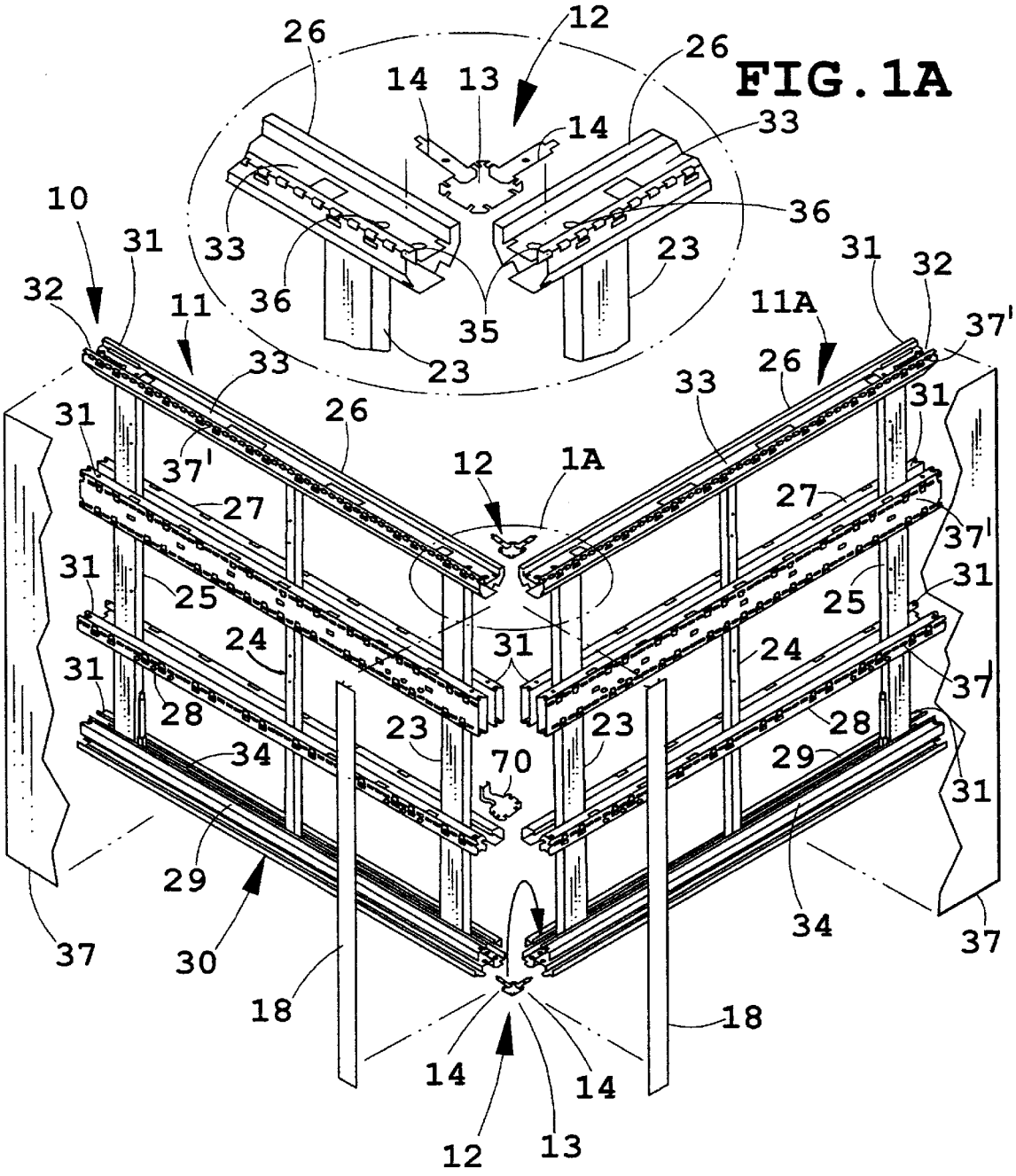
FIG. 1 is an exploded view of a partition system embodying the present invention, the partition system including a pair of identical panels with partition frames arranged in an L-shaped arrangement.

For purposes of description herein, the terms "upper", "lower", "right", "left", "rear", "front", "vertical", "horizontal", and derivatives thereof shall relate to the invention as oriented in FIG. 1 with the front face of the panels facing a person seated inside an office formed by the panels. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as unnecessarily limiting.

Figure 23:
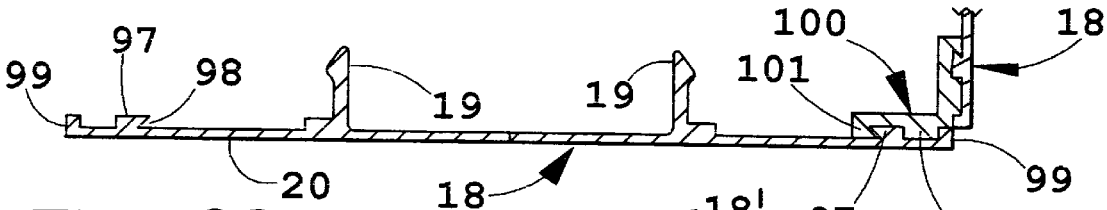
FIGS. 23 and 24 are cross sectional views of trim pieces as shown in FIGS. 1 and 2.

A partition system 10 (FIG. 1) embodying the present invention is provided for subdividing a building space. The partition system includes identical partition panels 11 and 11A interconnectable in one of in-line, "X", "T", or "L" shaped configurations by a connection system 12 that simulates a "post" type connection, but which does not include elongated, vertically-extending upright members. The connection system 12 includes vertically spaced center joint brackets 13 and frame brackets 14 attachable to the brackets 13 for connecting the panels in any one of the in-line, "X", "T", or "L" shaped arrangements. The joint brackets 13 (FIG. 3) each have four sides 15 with first and second connectors or interfacing features 16 and 17 on each side. The vertically spaced frame brackets 14 are constructed to rigidly connect the frame sections to the first connectors 16 on the joint brackets. Trim pieces 18 include attachment flanges 19 (FIG. 23) constructed to securely engage the second connectors 17 (FIG. 3) on the sides of the joint brackets. The trim pieces 18 (FIG. 23) each include a body panel 20 shaped to aesthetically cover an open area 21 (FIG. 3) defined between the panels when the open area is unoccupied, such as when there is no panel attached to a particular side of the joint brackets 13.

Panels of the type used herein are disclosed in detail in application Ser. No. 08/767,814, filed Dec. 17, 1996, entitled "PARTITION CONSTRUCTION", the entire contents of which are incorporated herein by reference. Nonetheless, to facilitate an understanding of the present invention, the panels are briefly described herein as follows in sufficient detail for a person of ordinary skill to understand the present invention. Panels 11 and 11A (FIG. 1) each include uprights 23–25 and horizontal frame members 26–29 welded together to form a rigid frame 30. Horizontal frame members 26–29 each include cantilevered end sections 31 that extend to the vertical side edges 32 of the panels 11 from the uprights. As apparent from FIG. 1, the horizontal frame members 26–29 need not all be identical. In the illustrated horizontal frame members, the top and bottom horizontal frame members 26 and 29 include cantilevered end sections with center flanges 33 and 34 that define channels. A first hole 35 (FIG. 1A) is located in each center flange and a nut is spot welded below the hole 35 to the center flange. Alternatively, it is noted that the hole 35 could be extruded from the center flange and threaded. A second aperture 36 spaced inward from hole 35 is formed in the center flanges but is not threaded. Cover panels 37 are secured to the frames 30 such as by spring clips that releasably engage slots 37' in frame members 26–29 to cover the frames.

Figure 4:
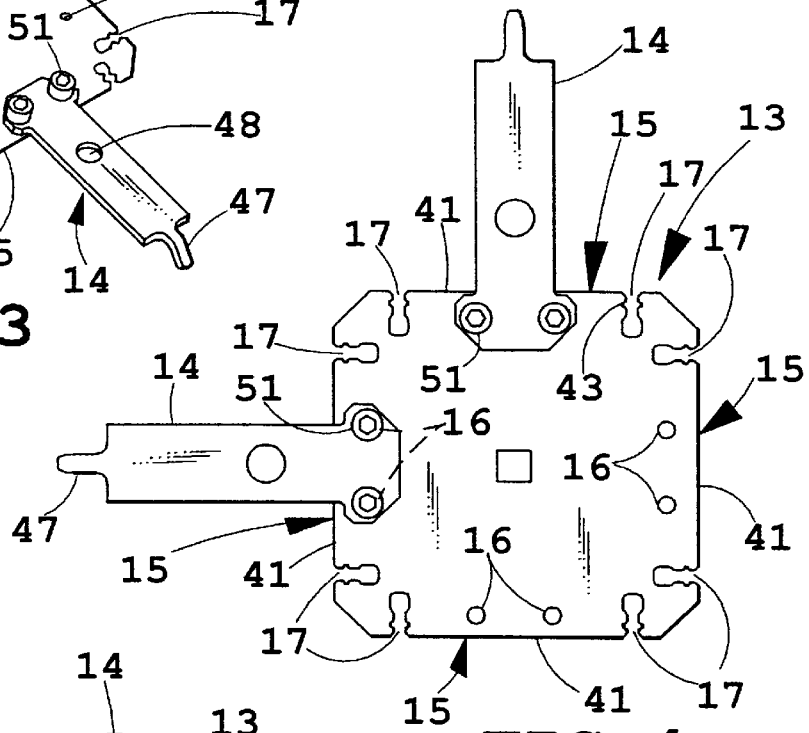
FIGS. 4 and 5 are top and side views of the connection system shown in FIG. 3.
Figure 5:
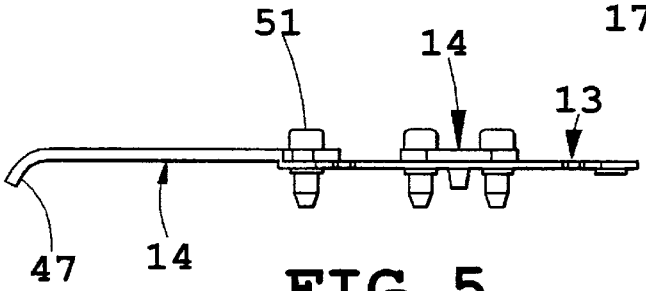

Joint brackets 13 (FIG. 4) are flat plates stamped from sheet metal into a square shape including sides 15 with flat edges 41. A pair of threaded holes or first connectors 16 are located on each side 15 symmetrically about the center thereof, as well as a pair of notches 17 also located symmetrically. The notches or second connectors 17 include barbs or irregular surfaces 43 for frictionally retaining trim pieces 44 (FIG. 1A) as described below.

Figure 3:
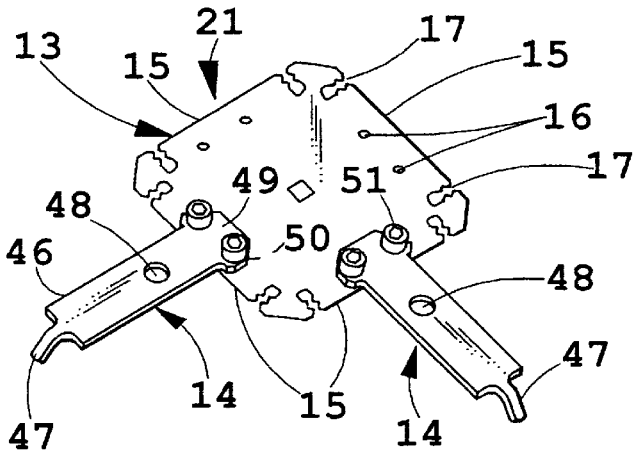
FIG. 3 is an enlarged perspective view of the connection system shown in FIG. 1 including a joint bracket and two frame brackets for connecting partition frames to the joint bracket in an L-shaped arrangement.
Figure 6:
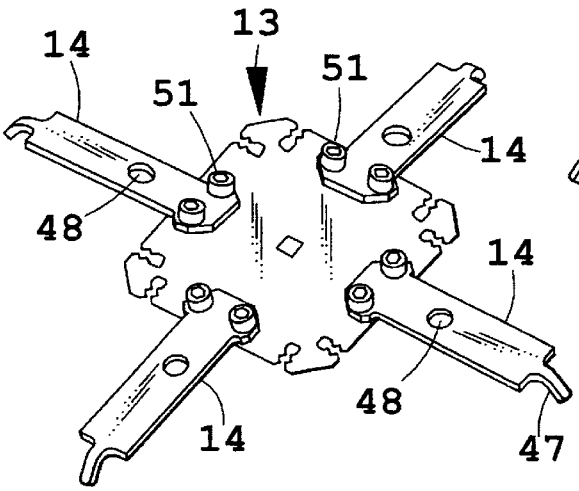
FIG. 6 is a perspective view similar to FIG. 3, but including four frame brackets.

Frame bracket 14 (FIG. 3) includes a tail end 46 having a width that is closely received in the channel of horizontal frame members 26 and 29 on center flanges 33 and 34 (see FIG. 1A). A finger 47 (FIG. 3) on the tail end 46 is angled downwardly so that it fits mateably into hole 36 (FIG. 1A) when installed. Hole 48 (FIG. 3) on the tail end 46 aligns with threaded hole 35 (FIG. 1A) for receiving a screw to securely fixedly retain the frame bracket 14 to a selected frame 11. Opposite end 49 (FIG. 3) is enlarged and includes a pair of holes 50 that align with threaded holes 16 in joint bracket 13. As shown in FIG. 6, one, two, three, or four frame brackets 14 can be attached to the joint bracket 13 by pairs of screws 51 in several different arrangements including in-line, "X", "T", or "L" shaped arrangements. For example, an L-shaped arrangement is shown in FIG. 3 and in FIG. 1. In the L-shaped arrangement, a pair of trim pieces 18 cover the unoccupied sides where there is an open area created by the spaced apart panels 11 and 11A.

Figure 2:
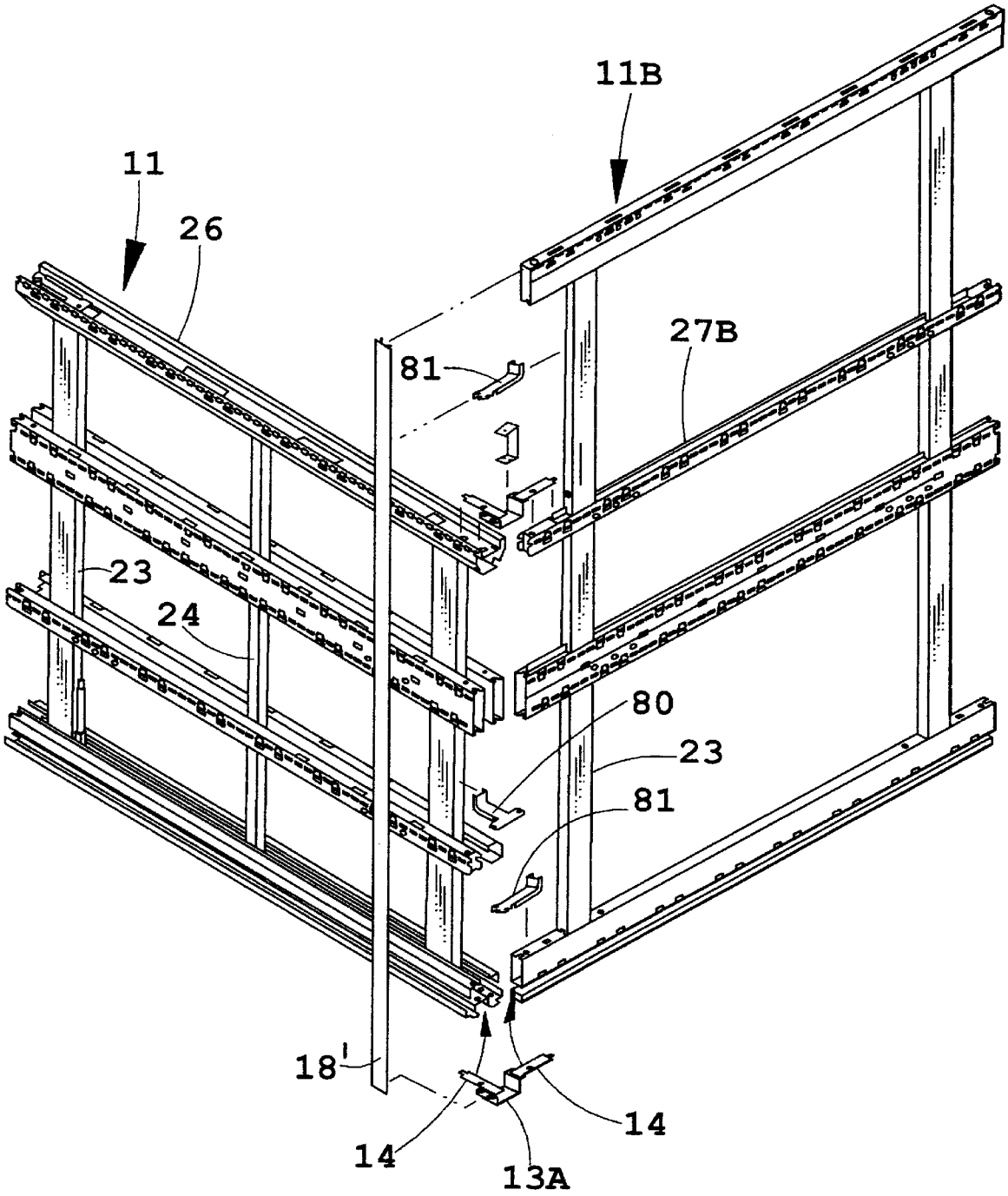
FIG. 2 is an exploded perspective view of a partition system including a pair of panels with dissimilar partition frames arranged in an L-shaped arrangement.
Figure 7:
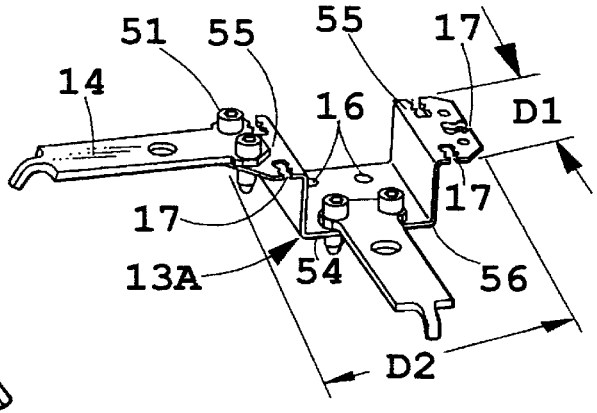
FIG. 7 is a perspective view of the top connection system shown in FIG. 2, the connection system including a modified joint bracket and two of the previously shown frame brackets arranged to interconnect the dissimilar panels in an L-shaped arrangement.

Notably, the horizontal frame members on different panels may be at different heights. For example, in FIG. 2, panel 11B has a horizontal frame member 27B that is located an inch or so above the horizontal frame member 26 on panel 11. Also, panel 11B is significantly thinner, having a total thickness of about 2 inches when the cover panels are attached, whereas the panel 11 has a total thickness of about 4 inches when its cover panels are attached. For this reason, a joint bracket 13A (FIG. 7) is provided having a lowered center section 54 and raised end sections 55. Notably, the joint bracket 13A is rectangular in plan view, and has a dimension D1 corresponding to the thickness of the panel 11B, while in another direction the dimension D2 corresponds to the thickness of panel 11. The lower center section 54 includes the threaded holes 16 on its side 56 for connection to a frame bracket 14. The barbed notches 17 for side 56 are located on the sides of the raised sections 55. Still another barbed notch 17 is located on the ends of the raised end sections 55.

Figure 8:
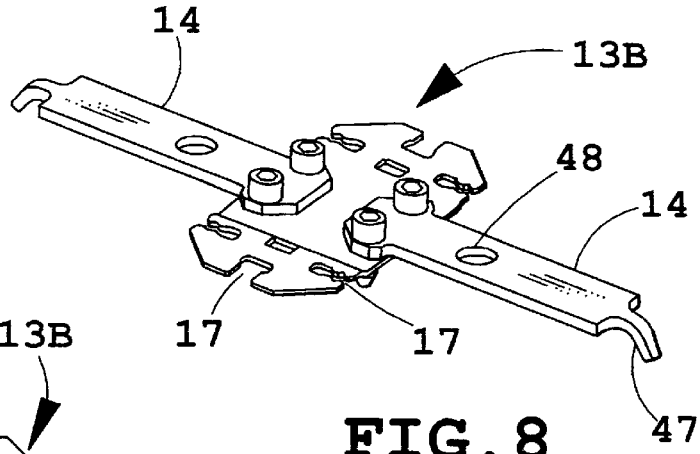
FIG. 8 is a perspective view of a connection system for interconnecting a pair of the partition frames shown in FIG. 1 in an in-line arrangement but with a reduced linear spacing.
Figure 9:
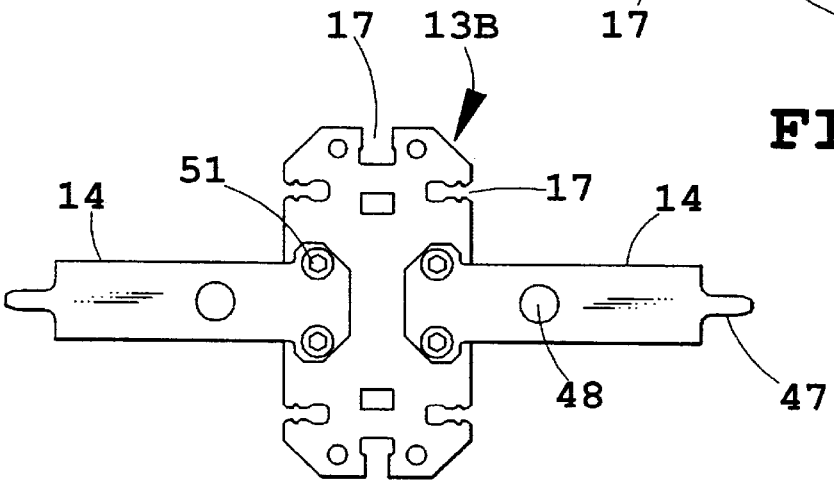
FIG. 9 is a top view of the connection system shown in FIG. 8.
Figure 10:
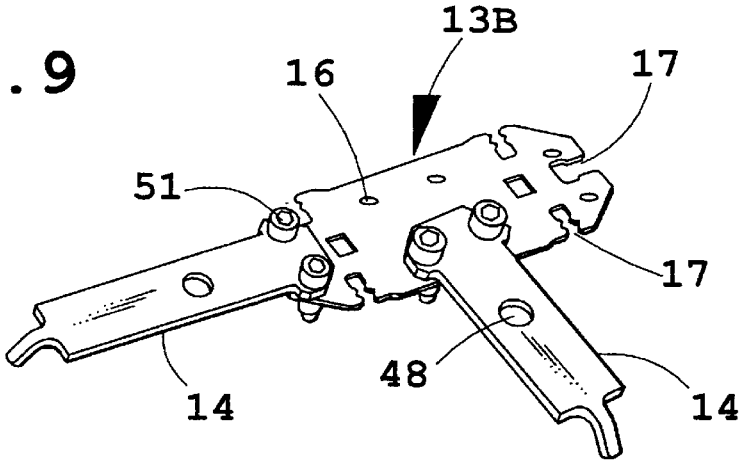
FIGS. 10 and 11 are perspective views showing the connection system shown in FIG. 8, the joint bracket being rectangular and configured to interconnect orthogonally positioned panels having two different thicknesses.
Figure 11:
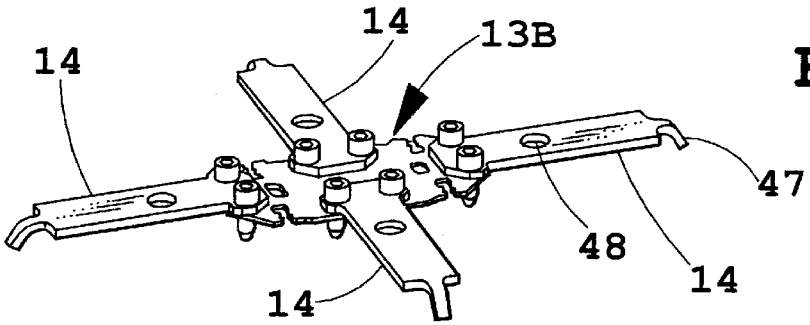

FIGS. 8–11 disclose a relatively flat joint bracket 13B that is adapted to interconnect two "thin" 2 inch panels 11B (FIG. 2) along a first direction and that is adapted to interconnect two "thick" 4 inch panels 11 along a second direction. As illustrated in FIG. 8, two frame brackets 14 are connected to the bracket 13B for making an in-line connection of 4 inch panels 11. FIG. 10 shows an L-shaped connection for connecting a first "thin" panel 11 to a second "thick" panel 11B. FIG. 11 shows an arrangement for interconnecting two in-line panels 11 with two in-line panels 11B in an X-shaped arrangement.

A joint bracket 13E provides for interconnecting two "thin" panels 11B in an L-shaped arrangement (FIGS.

Figure 15:
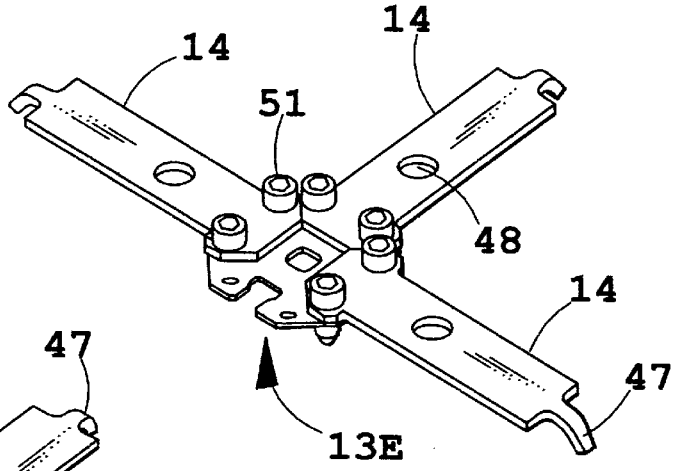
FIGS. 15 and 16 are perspective views showing the connection system of FIG. 12 used to connect partition frames in a T-shaped arrangement and in an X-shaped arrangement, respectively.
Figure 16:
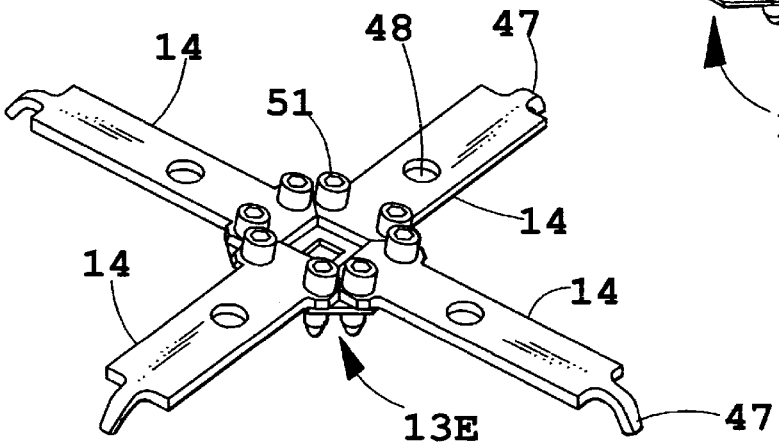

12–14), in a T-shaped arrangement (FIG. 15), or in an X-shaped arrangement (FIG. 16).

Figure 17:
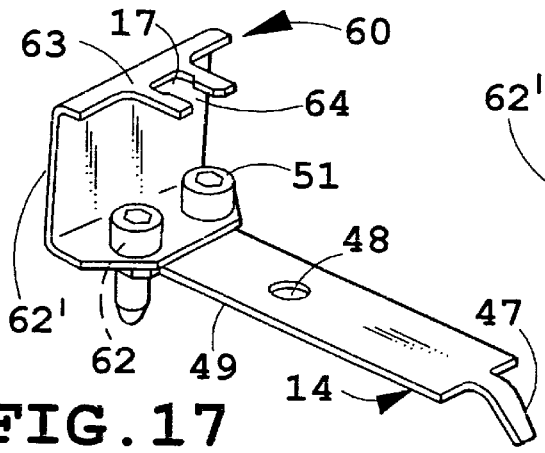
FIGS. 17 and 18 are perspective and side views of a first trim-supporting bracket, such as is shown in FIG. 2, the trim-supporting bracket being located at a top of the shorter panel to receive a trim piece to cover an exposed end of the taller frame.
Figure 18:
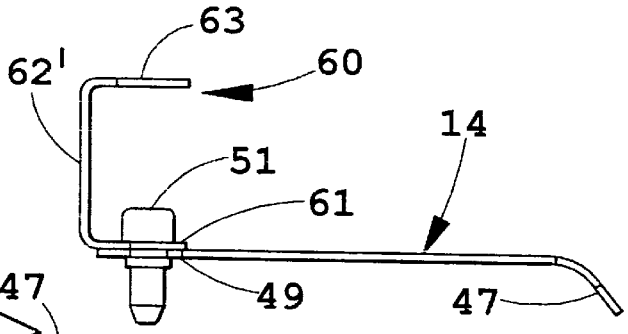

FIG. 17 discloses a C-shaped trim bracket 60 attachable to a frame bracket 14 for providing additional support to the trim piece 18'. The trim bracket 60 includes a bottom flange 61 having a pair of holes 62 therein for receiving screws 51 for connecting it to the opposite end 49 of frame bracket 14. The C-shaped bracket 60 further includes a vertical flange 62' and top flange 63 having a notch 64 therein for supporting the trim piece 18'. Notably, the trim bracket 60 could be made reversible so that it faces toward or away from the finger 47. Trim bracket 60 is particularly useful when different height panels are interconnected.

Figure 19:
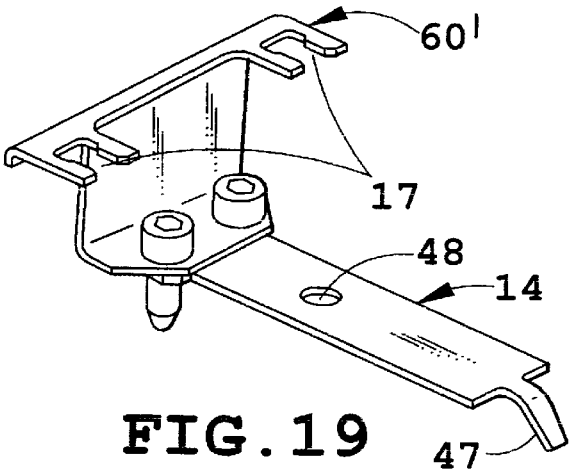
FIG. 19 is a perspective view of a second alternative trim-supporting bracket.

FIG. 19 illustrates an additional trim bracket 60' similar to trim bracket 60, but that is wider and adapted for the trim piece 18 to cover the space above the end of a 4 inch wide panel 11.

Figure 20:
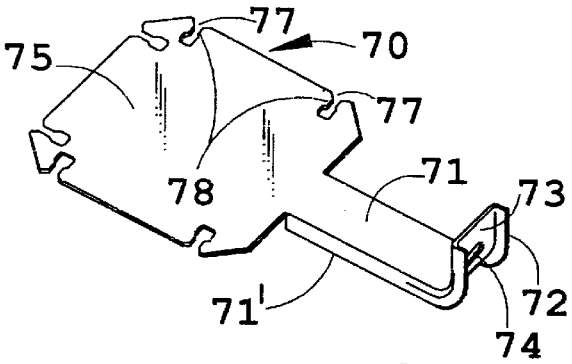
FIGS. 20–22 are perspective views of intermediate trim-supporting brackets for supporting trim pieces at intermediate vertical locations on the uprights of the partition frames shown in FIGS. 1 and 2.
Figure 21:
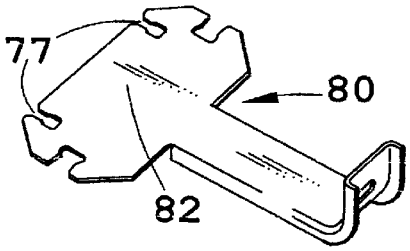
Figure 22:
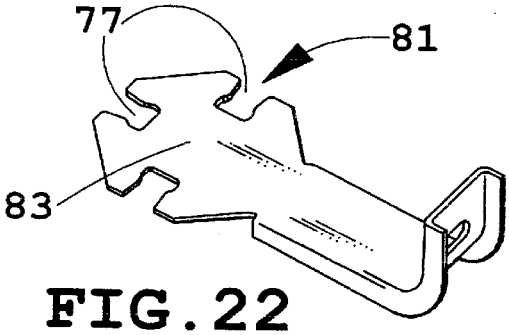

In certain circumstances, such as where the horizontal frame members 26–29 are spaced vertically a significant distance apart, an installer may want to provide additional support for the trim piece 18 so that it does not warp or bend out of position. In such case, an extra trim support 70 (FIG. 20) is shown having a horizontal leg 71 with reinforcement ribs 71'. An upturned end 72 defines a recess 73 for mateably and stably engaging a side of the uprights 23. A hole 74 in the upturned end 72 is configured to receive a screw for attaching the support 70 to the upright 23. The opposite end 75 includes an enlarged flat flange having notches 77 with barbs 78 therein for engaging attachment flanges on the trim piece 18. The trim piece 18 is constructed for use at a junction of 4 inch thick panels 11. FIGS. 21 and 22 illustrate additional trim supports 80 and 81, each having enlarged flanges 82 and 83, respectively, with dimensions shaped to correspond to particular panel thicknesses. For example, trim support flange 80 is adapted to be located at a joint for connecting two 2 inch wide panels 11B and one 4 inch panel 11, while support 81 is adapted to be used at a joint formed by 2 inch wide panels 11B.

Figure 12:
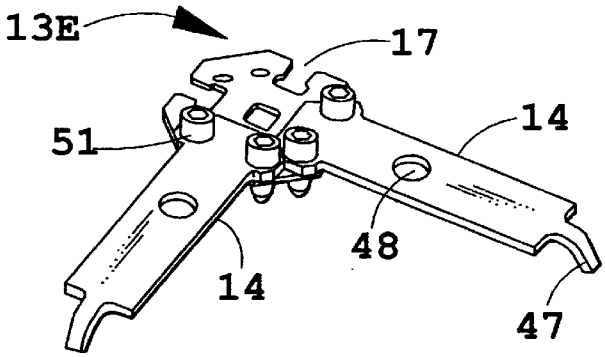
FIG. 12 is a perspective view showing a connection system for connecting two relatively thin partition frames in an L-shaped arrangement.
Figure 13:
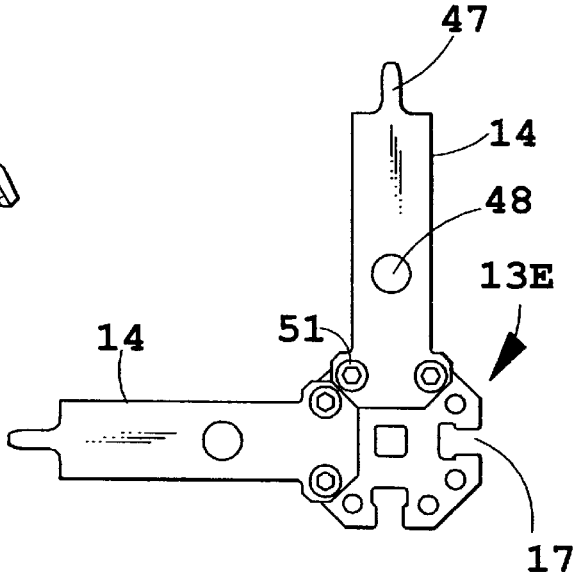
FIGS. 13 and 14 are top and side views of the connecting system shown in FIG. 12.
Figure 14:
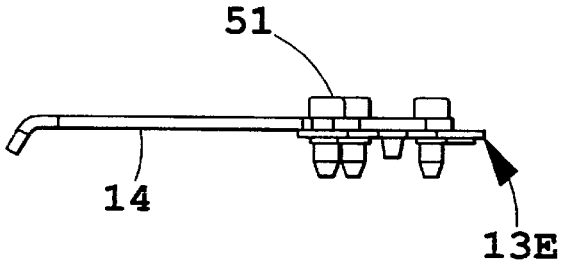
Figure 24:
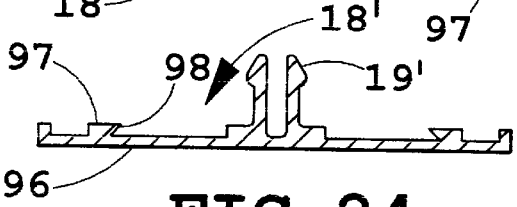

Trim pieces 18 come in different sizes to correspond to the thickness dimension of the panel to which they are attached. End trim piece 18 (FIG. 23) includes a pair of spaced apart attachment flanges 19 on its body 20. The attachment flanges 19 are adapted to enter the spaced apart notches 17 of the brackets shown in FIGS. 3 and 19, and to frictionally interferingly engage barbs 43 to provide a quick retention system without the use of separate fasteners. The body of trim piece 18 has a width of about 4 inches, for trimming out the end of a panel 11. Another trim piece 18' (FIG. 24) has attachment flanges 19' which are spaced closed together for engaging a single notch 17 (see FIGS. 12 and 17). The attachment flanges 19' are also configured to fit into the notch and frictionally interferingly engage barbs 43. The width of the body 96 of trim piece 18 is about 2 inches and is configured to trim out an end of the panel 11B. A ridge 97 (FIGS. 23–24) on the back side of the trim pieces 18 and 18' includes an undercut lip 98 that can be engaged to control the edge 99 (FIG. 23) of the trim pieces. For example, an L-shaped edge connector 100 (FIG. 23) includes matingly shaped ridges 101 and 102 so that it can be used to form a clean, light-shielded joint on an L-shaped arrangement of two trim pieces 18. Alternative light shields are also contemplated, such as tape, fabric, flaps, and fuzzy materials applied at the corners.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A partition system for subdividing a building space, comprising:

a plurality of panels each defining vertical side edges and vertically spaced frame sections at the vertical side edges; and a connection system for connecting the panels together around a post-simulating joint where the panels are selectively arrangeable in one of an in-line, "T" and "L" shaped arrangement, the connection system including:

vertical spaced joint brackets for selectively connecting the panels in the one selected arrangement, each joint bracket having sides with threaded connectors and barbed notches;

vertically spaced frame brackets connecting the vertically spaced frame sections to selected ones of the threaded connectors; and trim pieces attached to the barbed notches on unoccupied sides of the joint brackets where there is no panel attached, the trim pieces each being shaped to aesthetically cover an open area between the panels on the unoccupied sides.

2. The partition system defined in claim 1 wherein the joint brackets comprise flat plates with the notches formed in the sides of the joint brackets.

3. The partition system defined in claim 2 wherein the notches include opposing retention barbs.

4. The partition system defined in claim 3 wherein the sides of the joint brackets include a straight edge.

5. The partition system defined in claim 1 wherein at least some of the frame sections of the panels are horizontally misaligned, and wherein at least one of the joint brackets has vertically spaced sides for connecting the horizontally misaligned frame sections.

6. The partition system defined in claim 1 wherein the plurality of panels includes first panels having a first thickness and second panels having a different thickness, and wherein the joint brackets are rectangularly shaped with dimensions corresponding to the first thickness and the different thickness.

7. The partition system defined in claim 1 wherein the frame sections include cantilevered end sections, and the frame brackets have tail sections configured to mateably engage the cantilevered end sections.

8. The partition system defined in claim 7 wherein the cantilevered end sections have an aperture, and wherein the tail sections have a finger for engaging the aperture.

9. The partition system defined in claim 8 wherein the cantilevered end sections each have a threaded hole, and wherein the tail sections have another hole that aligns with the threaded hole for receiving a fastener to secure the frame bracket to the cantilevered end sections.

10. The partition system defined in claim 1 wherein the trim pieces include a flat body and include protrusions extending from the body for frictionally engaging the barbed notches.

11. The partition system defined in claim 10 wherein the trim pieces including the protrusion comprise extruded polymeric material.

12. The partition system defined in claim 1 including a separate trim-supporting bracket configured to connect to an upright on the panels, the separate trim-supporting bracket having third connectors thereon for providing added support to the trim pieces at locations between the vertically spaced joint brackets.

13. The partition system defined in claim 1 wherein the vertically spaced frame sections are end sections of horizontally extending frame members that define channels for receiving the frame brackets.

14. A partition system comprising:

a pair of frames defining vertical side edges, the frames each having horizontal frame members and uprights spaced horizontally from the vertical side edges for supporting the horizontal frame members, the horizontal frame members having cantilevered end sections extending to the vertical side edges from the uprights;

frame brackets each having a tail end configured for rigid secure connection to a selected one of the cantilevered end sections and having an opposite end, the frame brackets each being a relatively flat part such that the tail end and the opposite end lie substantially in a common plane and are easily manufactured by a stamping operation; and joint brackets having sides and apertures on each side for receiving fasteners to secure the opposite end to the joint bracket on a selected side.

15. The partition system defined in claim 14 wherein the joint bracket comprises a stamped, flat part.

16. The partition system defined in claim 15 wherein the joint bracket is also a stamped, flat part.

17. In a partition system for subdividing building space, the partition system including at least a first panel having a first partition frame with a first vertical side edge, and a second panel having a second partition frame with a second vertical side edge spaced horizontally from the first vertical side edge; a connection system comprising:

joint brackets and frame-engaging brackets configured to attach partition frames to the joint brackets, the joint brackets each being a stamped flat part with straight side edges defining sides, each side having threaded holes and notches, each frame-engaging bracket including a tail end attached to one of the first and second frames, and further including cantilevered ends screw-attached to the threaded holes on the joint bracket.

18. The system defined in claim 17, including a vertically elongate trim piece engaging one of the notches to cover an open space between the first and second panels, the open space occurring when a particular one of the sides is unoccupied and not connected to any of the partition frames.

* * * * *

US005867955B1

REEXAMINATION CERTIFICATE (4198th)

United States Patent [19] [11] B1 5,867,955

Russell [45] Certificate Issued Nov. 7, 2000

[54] PANEL-TO-PANEL CONNECTORS FOR OFFICE PARTITIONS

[75] Inventor: Scott H. Russell, Kalamazoo, Mich.

[73] Assignee: Steelcase Inc., Grand Rapids, Mich.

Reexamination Request:
No. 90/005,493, Sep. 10, 1999

Reexamination Certificate for:

| | |
|---|---|
| Patent No.: | **5,867,955** |
| Issued: | **Feb. 9, 1999** |
| Appl. No.: | **08/892,010** |
| Filed: | **Jul. 14, 1997** |

[51] Int. Cl.[7] ..... E04B 2/74

[52] U.S. Cl. ..... 52/239; 52/285.2; 52/582.1

[56] References Cited

U.S. PATENT DOCUMENTS

| | | |
|---|---|---|
| 3,514,883 | 6/1970 | Albright . |
| 4,619,486 | 10/1986 | Hannah et al. . |
| 4,883,330 | 11/1989 | Armstrong et al. . |

OTHER PUBLICATIONS

Exhibit A is a brochure entitled *Knoll—Hannah Desk System*, 18 pages, dated Oct. 1986.

Exhibit B is a brochure entitled *Knoll—Hannah Desk System*, 13 pages, undated but published in 1986.

Exhibit C is a publication entitled *Knoll—Hannah Desk System—Electrical Assembly Guide*, (12 pages), undated but published in 1986.

Exhibit D is a publication entitled *Knoll—Hannah Desk System—Assembly Guide*, 12 pages, undated but published in 1986.

*Primary Examiner*—Michael Safavi

[57] ABSTRACT

A partition system is provided for subdividing a building space. The partition system includes different partition panels interconnectable in one of in-line, "X", "T", or "L" shaped arrangements by a connection system that simulates a "post" type connection, but which does not include vertically extending upright components. The connection system includes vertically spaced joint brackets for connecting the panels in the selected arrangement. The joint brackets each have sides with threaded connectors and barbed notches on each side. Vertically spaced frame brackets are used to rigidly connect the frame sections to the joint brackets. Trim pieces are constructed to securely engage the barbed notches on unoccupied sides of the joint brackets when there is a gap formed by absence of a panel on the unoccupied sides.

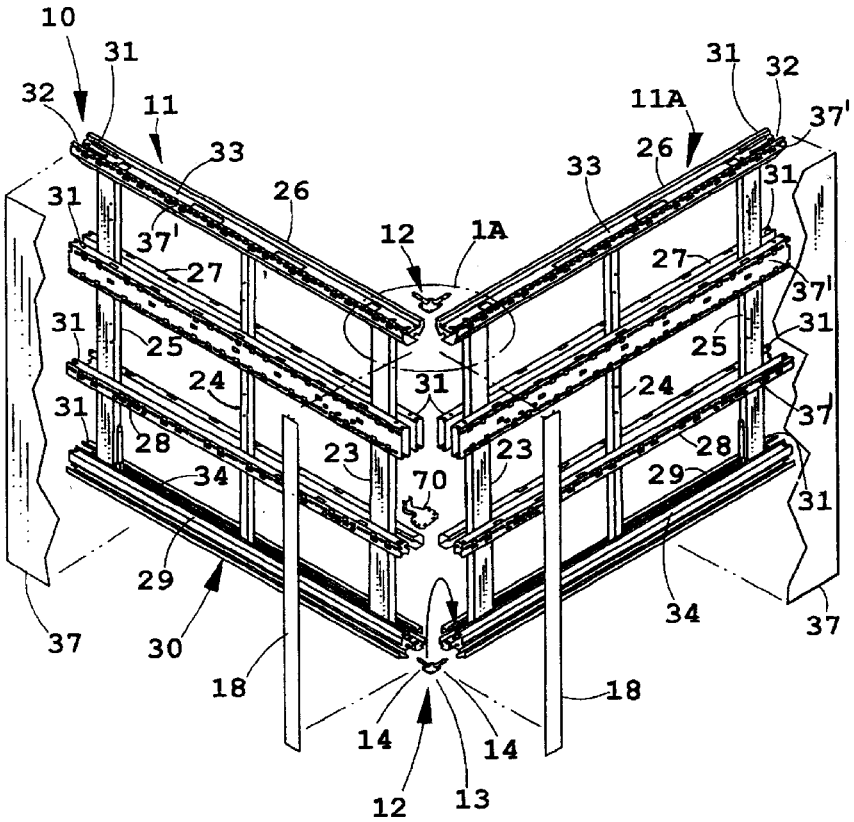

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–18 is confirmed.

* * * * *